US005222828A

United States Patent [19]

Magalski

[11] Patent Number: 5,222,828

[45] Date of Patent: Jun. 29, 1993

[54] DEVICE FOR CLEANING AND LUBRICATING THE EXTERIOR SURFACE OF ASPHALT COMPACTING DRUMS

[75] Inventor: Edward D. Magalski, York, Pa.

[73] Assignee: Ingersoll-Rand Company, Woodcliff Lake, N.J.

[21] Appl. No.: 785,126

[22] Filed: Oct. 30, 1991

[51] Int. Cl.[5] ..... E01C 19/28; E01C 19/26; B60B 19/12

[52] U.S. Cl. ..... 404/103; 404/124; 404/129; 180/20

[58] Field of Search ..... 404/122, 124, 129, 121, 404/103, 117; 180/18, 20; 29/110

[56] References Cited

U.S. PATENT DOCUMENTS

| | | | |
|---|---|---|---|
| 264,514 | 9/1882 | Comp et al. | 404/129 |
| 269,581 | 12/1882 | Jones | 404/129 |
| 2,830,551 | 4/1958 | Wills et al. | 404/129 X |
| 3,675,546 | 7/1972 | Smith | 94/50 |
| 3,802,339 | 4/1974 | Anderson et al. | 100/174 |
| 3,875,666 | 4/1975 | Cline | 33/174 |
| 4,040,762 | 8/1977 | Nilsson | 404/129 |
| 4,348,134 | 9/1982 | Goehler | 404/129 |
| 4,378,052 | 3/1983 | Anderson | 172/449 |
| 5,022,783 | 7/1991 | Jones | 404/122 |

*Primary Examiner*—Ramon S. Britts
*Assistant Examiner*—Nancy Connolly
*Attorney, Agent, or Firm*—John J. Selko

[57] ABSTRACT

A device for cleaning and lubricating an exterior surface of an asphalt compacting machine includes a support member removably attached to the machine. Positioned on the support member for easy access are a flexible scraper for cleaning the drum and a fluid spray system, for spraying and uniformly distributing a lubricating fluid onto the drum. Elastic spring means on the support member assures positive contact between the drum and the scraper and between the drum and the fluid distributor.

8 Claims, 5 Drawing Sheets

DEVICE FOR CLEANING AND LUBRICATING THE EXTERIOR SURFACE OF ASPHALT COMPACTING DRUMS

BACKGROUND OF THE INVENTION

This invention relates generally to asphalt compacting machines and more particularly to devices that clean and lubricate the exterior surface of the drums of asphalt compacting machines.

It is well known that the exterior surface drums used on asphalt compacting machines require lubricating and cleaning during their use. The lubricating is for the purpose of minimizing adherence of particles or other matter to the exterior surface of the drum. Various combinations of devices have been utilized to achieve these functions. Heretofore, these combinations have consisted of elements separately mounted on the machine body. The mounting of these separate elements on the machine during manufacture or repair has been complicated and time consuming because of limited access to all the elements thereof by the mechanic.

The foregoing illustrates limitations known to exist in present asphalt drums. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a device for cleaning and lubricating the exterior surface of asphalt drums that includes a support member removably attached to the asphalt machine body for supporting, along the width of the drum and spaced therefrom, a cleaning and lubricating means that includes fluid spray means, fluid distribution mat means, flexible scraper blade means and spring means for providing positive contact between the mat means and the drum surface and also between the scraper blade and the drum surface.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
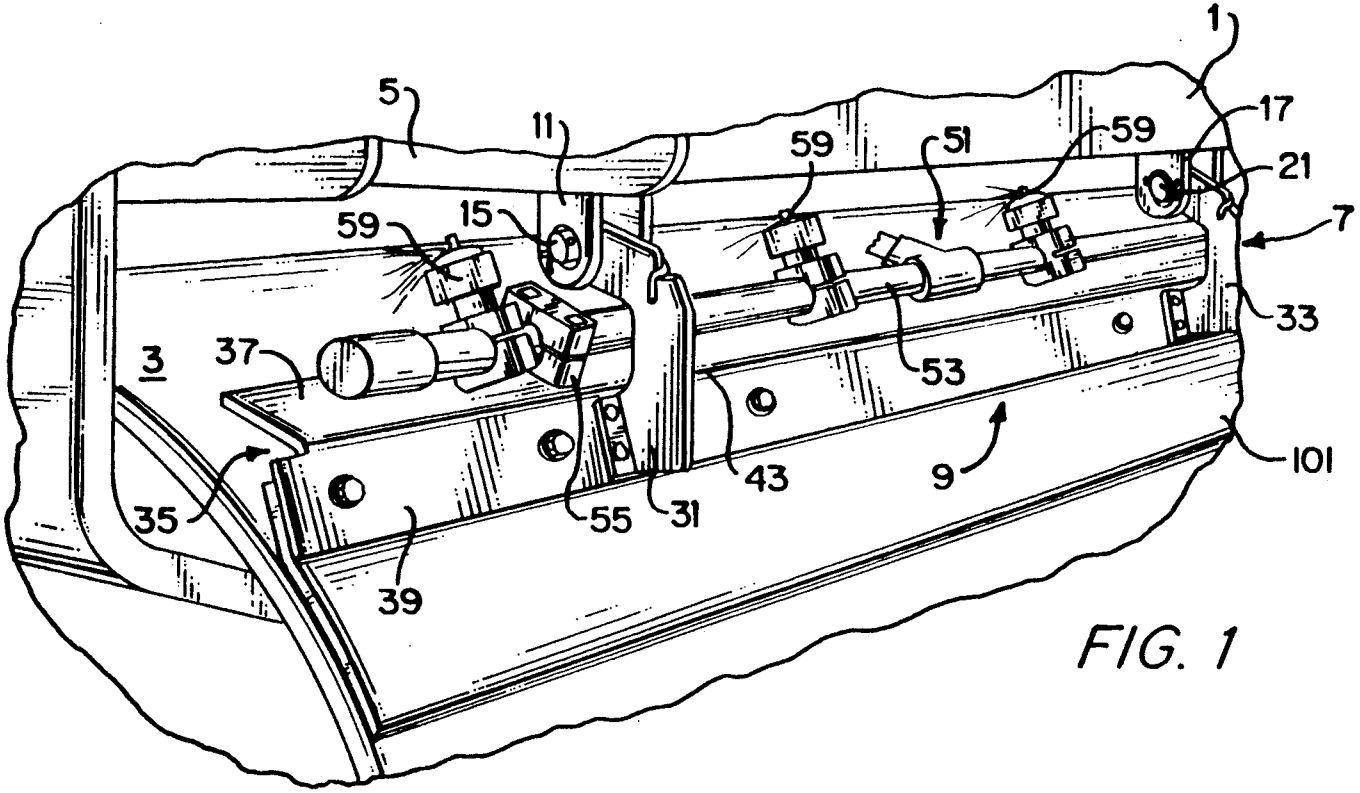
FIG. 1 is an perspective view of the invention mounted above a drum, with parts removed.
Figure 2:
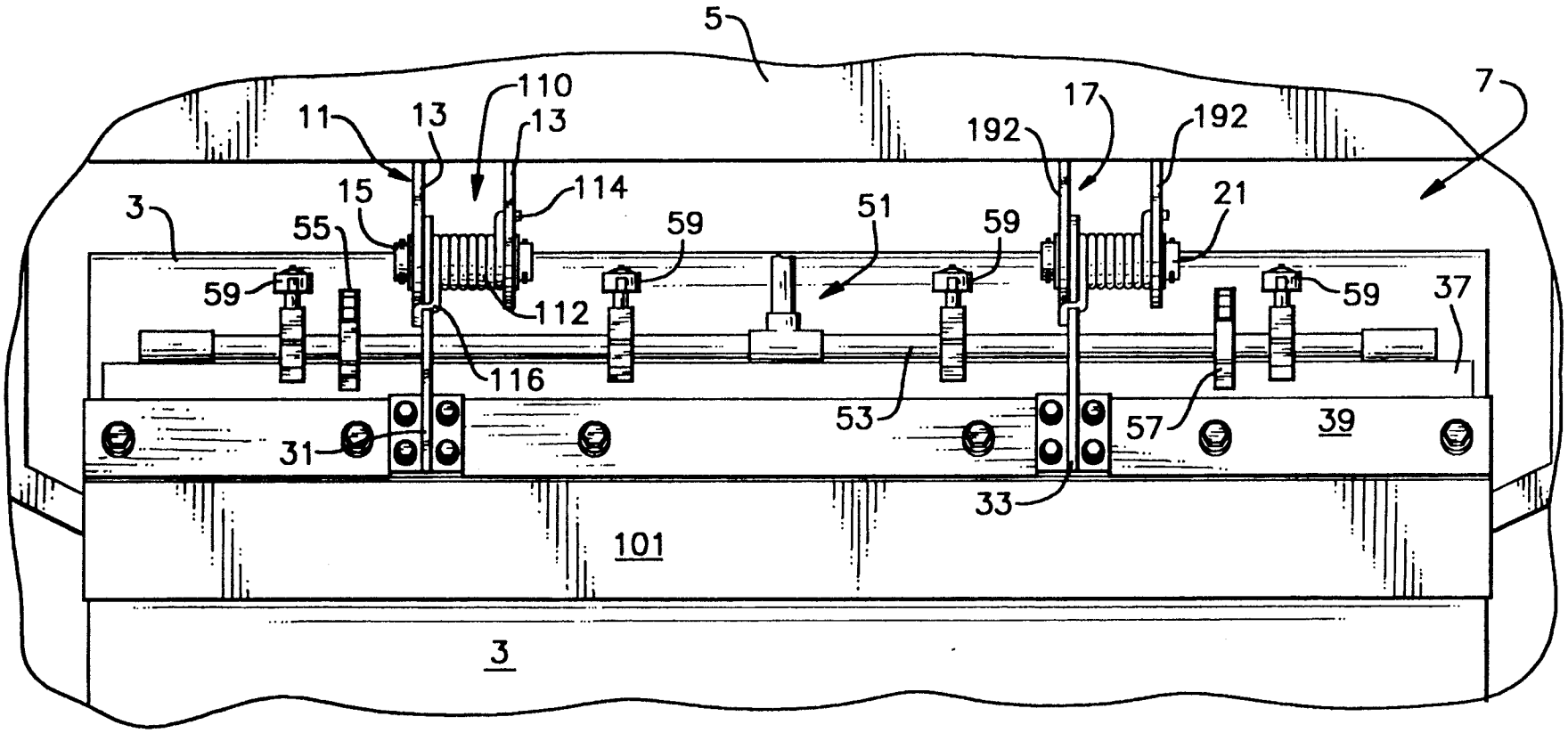
FIG. 2 is a front elevational view, with parts removed, of a compacting machine, showing the invention mounted thereon.

Referring to FIGS. 1 and 2 there is shown an asphalt compacting machine 1 having a drum 3 mounted thereon for rotation about a horizontal axis (not shown), as is conventional.

Removably attached to a portion of the body 5 of the machine 1 is the invention shown generally as 7. The invention includes a support member 9 that has mounted thereon means for cleaning and lubricating the surface of drum 3, as described hereinafter. Support member 9 extends along the width of drum 3 parallel to the axis of rotation of drum 3. Support member 9 is spaced above the surface of drum 3.

Support member 9 includes a first support bracket 11 affixed to a body portion 5 of machine 1, and extending downwardly therefrom. Bracket 11 includes a pair of parallel spaced-apart lugs 13 that have affixed between them a horizontal pivot shaft 15. Shaft 15 is spaced above the drum 3 and parallel to the width of drum 3.

Support member 9 includes a second support bracket 17 affixed to a body portion 5 of machine 1, and extending downwardly therefrom. Bracket 17 includes a pair of parallel spaced-apart lugs 19 that have affixed between them a horizontal pivot shaft 21. Shaft 21 is spaced above the drum 3 and parallel to the width of drum 3. Brackets 11 and 17 are spaced apart from each other along the width of drum 3.

A first support arm 31 is pivotably mounted on first support bracket 11 for pivoting up and down about pivot shaft 15. Support arm 31 extends downwardly toward drum 3.

A second support arm 33 is pivotably mounted on second support bracket 17 for pivoting up and down about pivot shaft 21. Support arm 33 extends downwardly toward drum 3.

Figure 3:
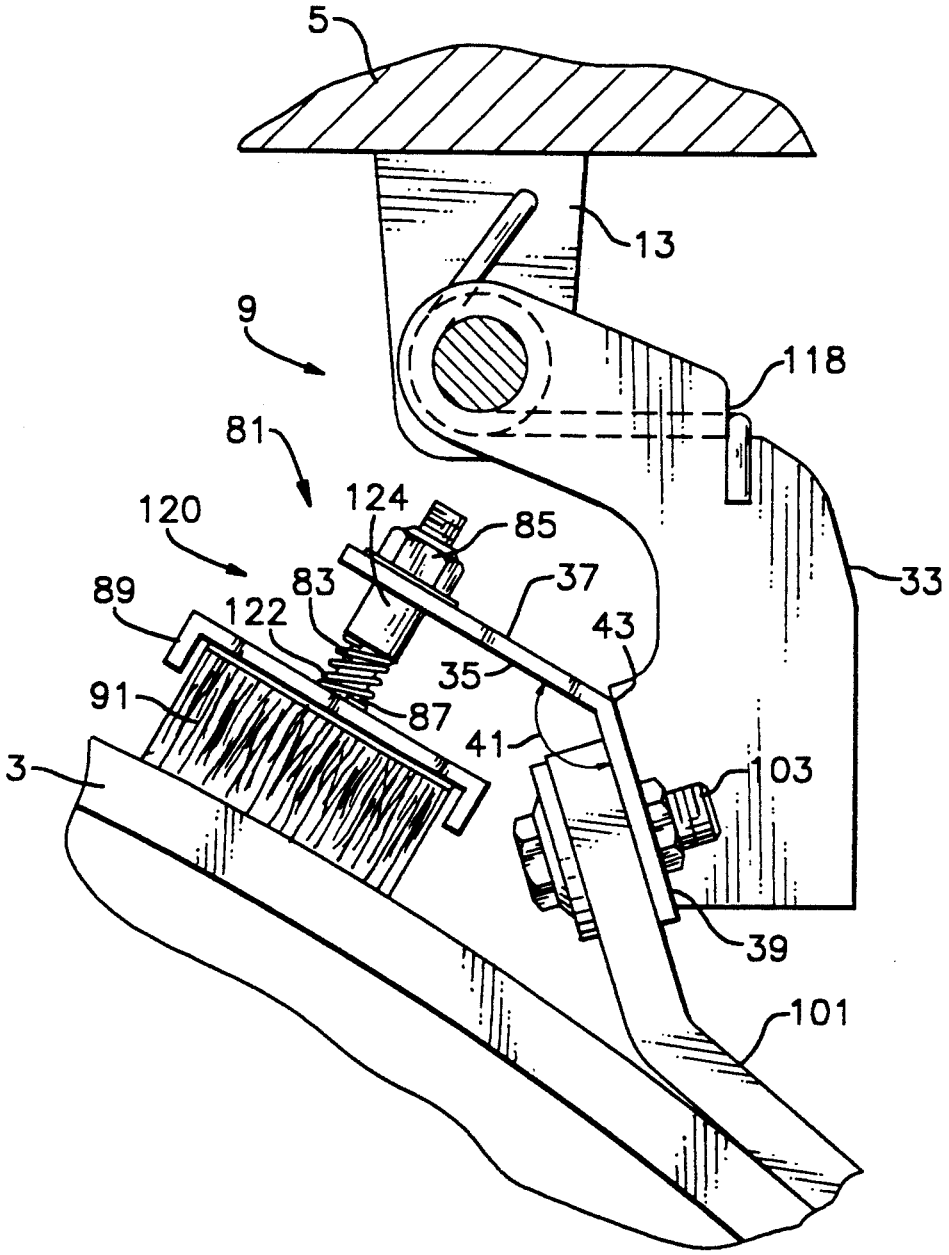
FIG. 3 is a side elevational view, with parts removed, showing the scraper and mat in resilient contact with the drum of a compacting machine.

As shown in FIG. 3, a mounting plate 35 is affixed, as by welding or nuts and bolts, to support arms 31 and 33. Plate 35 is spaced above the drum 3 and extends along the width of drum 3. Plate 35 has an upper mounting segment 37 and a lower mounting segment 39. Segments 37 and 39 intersect to form an angle 41 that opens toward drum 3, and is referred to herein as a downwardly facing angle. Angle 41 has an apex 43 parallel to the width of drum 3.

Figure 4:
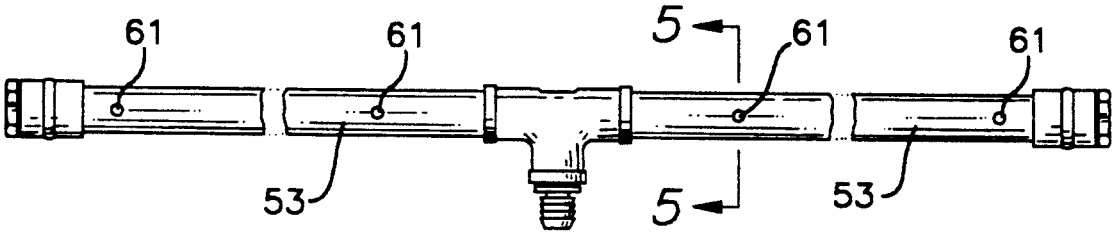
FIG. 4 is a plan view of the spray bar, with parts removed.

Mounted on upper mounting segment 37 is fluid spray means 51. As used herein, the term "fluid" refers to water, but other types of fluid can be used with the invention. As shown in FIGS. 1 and 2, fluid spray means 51 includes a hollow tubular fluid spray bar 53 mounted on upper segment 37 by means of a pair of spaced-apart clamps 55 and 57. Spray bar 53 extends along the width of drum 3, and has a plurality of spray nozzles 59 mounted thereon, around apertures 61 (FIG. 4). Nozzles 59 are spaced apart along the width of the drum 3. I prefer four nozzles, although more or fewer can be used, so long as the spray pattern of fluid is sufficient to cover the surface of drum 3 to provide the lubricating needed. Nozzles 59 fluidly communicate with spray bar 53 in a conventional manner.

Figure 5:
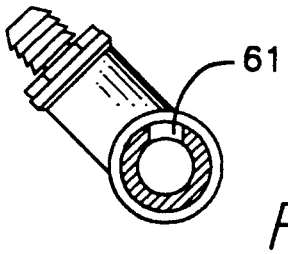
FIG. 5 is a section along lines 5—5 of FIG. 4.
Figure 6:
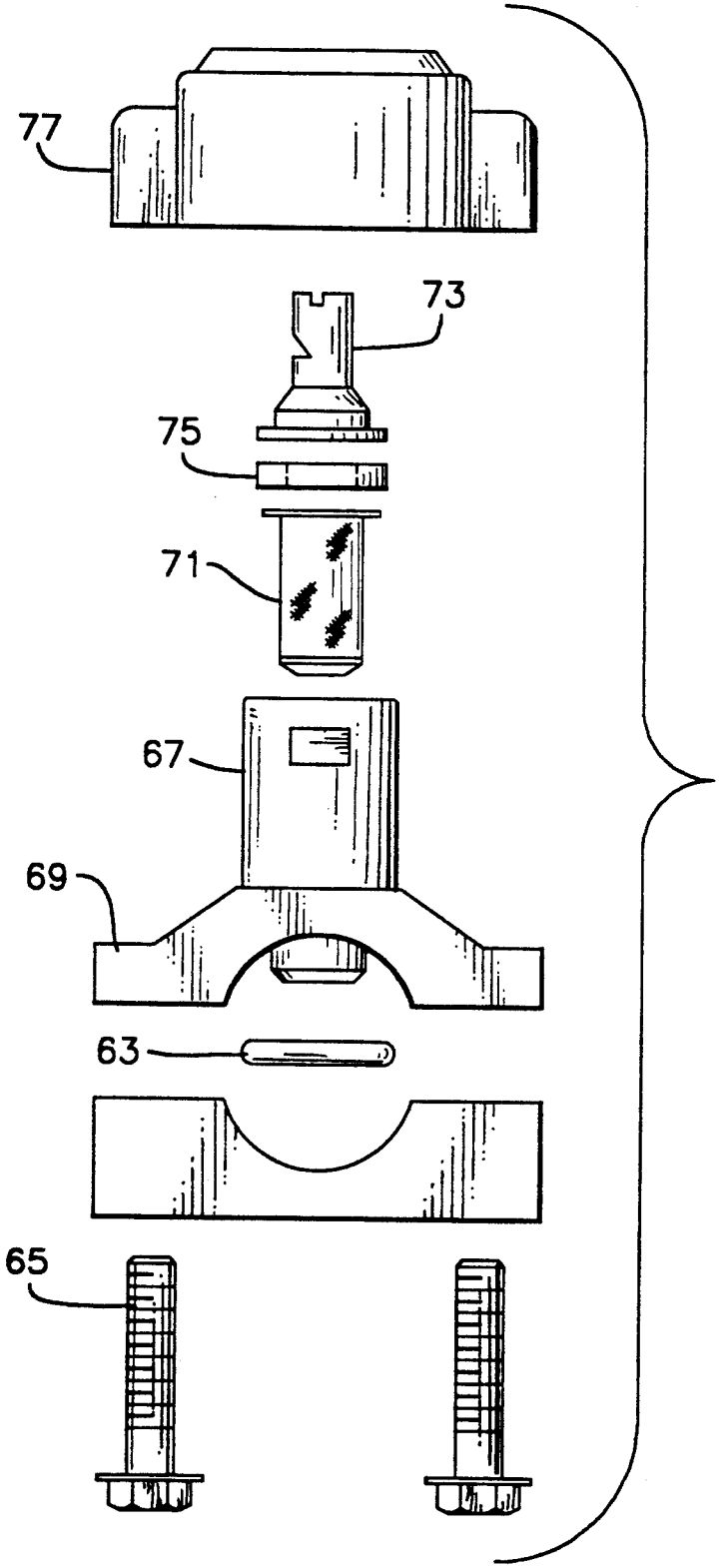
FIG. 6 is an exploded view of a spray nozzle assembly, used with the invention.

FIG. 5 shows the preferred spray nozzle assembly. A split eyelet 63 spans spray bar 53 around an aperture 61 in the wall of spray bar 53. Eyelet 63 is clamped around spray bar 53 by conventional means, such as screws 65. A hollow, tubular stem 67 is carried by the split eyelet 63 and extends into the aperture 61 in spray bar 53. Gasket 69 assures a fluid tight seal, as is well known. Positioned within the stem is a mesh strainer 71. A nozzle 73 and gasket 75 combination fluidly communicate through the stem 67, and a removable cap 77 holds the assembly together, as is well known. Spray bar 53 is connected by conventional piping to a source of fluid (not shown) such as a pump, for a pressurized system or a tank for a gravity fed system.

Referring now to FIG. 3, there is shown the flexible absorbent mat means 81 mounted on upper segment 37 of support member 9. Mat means 81 extends along the width of drum 3, and contacts the surface of drum 3, to spread fluid from spray means 51 in a uniform distribution on the surface of drum 3.

Absorbent mat means 81 comprises a plurality of shafts 83 extending downwardly from upper segment 37, said shafts being spaced along the width of drum 3. Each shaft 83 slidably extends through an aperture in upper segment 37. Each shaft 83 has an upper end on which is threaded a nut 85 that is larger than the aperture, so that the shaft 83 cannot slide out of connection with upper segment 37. Each shaft 83 has a lower end 87 extending downwardly toward drum 3. Affixed to each shaft 83, as by welding, is a U-shaped mat holder 89. Mat holder 89 extends along the width of drum 3 and has mounted therein a mat 91 of suitable material. Mat 91 can be mounted in holder 89 by force-fit, or by other suitable and conventional means. I prefer mat 91 to be a vinyl-backed cocoa mat because that material combines the attributes of flexibility, fluid absorption, and strength to withstand the abrasion and rubbing against the surface of drum 3. Other well known materials will also work.

Referring now to FIG. 3, there is shown the flexible scraper blade means 101 mounted on lower segment 39 of support member 9. Scraper blade means 101 extends along the width of drum 3, and contacts the surface of drum 3 to remove debris adhering to the surface of drum 3. Scraper blade means 101 comprises a flexible elastomer or rubber blade removably affixed with nuts and bolts 103. I prefer the scraper blade material to be one-half inch thick styrene butadiene, with a hardness of 80 durometer on the A scale, but other well know materials will also work.

Referring now to FIG. 2, there is shown the first elastic torsion spring means 110. The same spring means 110 are mounted on both pivot shafts 15 and 21, and a description of one will suffice for both. A conventional torsion spring 112 is concentrically mounted on pivot shaft 15. Spring 112 has a first end 114 that extends through an aperture in one of the lugs 13 of bracket 11. A second end 116 of spring 112 is positioned in notch 118 of support arm 31. By reason of the torsional elastic force exerted by the spring 112, arm 31 is urged pivotably downward toward drum 3 therebelow, causing the scraper blade means 101 to maintain contact with drum 3. The spring means 110 on pivot shaft 21 acts in a similar manner.

Referring now to FIG. 3, there is shown the second elastic spring means 120. The same spring means 120 are mounted on each shaft 83, and a description of one will suffice for all. A conventional elastic spring 122 is concentrically mounted on shaft 183. Spring 122 is compressionally mounted between the back of mat holder 91 and the bottom surface of upper segment 37. I prefer to space a bushing 124 slidably positioned between spring 122 and upper segment 37, in order to adjust the amount of force exerted by spring 122. By reason of the elastic force exerted by the spring 122, the mat holder 91 is urged downwardly toward drum 3, to urge mat 91 into contact with the drum 3. The spring means 120 on all other shafts 83 act in a similar manner.

While this invention has been illustrated and described in accordance with a preferred embodiment, it is recognized that other variations and changes may be made therein without departing from the invention as set forth in the claims. In particular, while this invention has been described for use with a compactor having a static or vibrating drum, it can also be used on machines that use pneumatic compaction tires.

Having described the invention, what is claimed is:

1. A device for cleaning and lubricating an exterior surface of a drum on an asphalt compacting machine comprising:

a. support member means removably attached to the machine, for supporting a cleaning means and a lubricating means along the width of the drum and spaced from the drum surface, said support member means including a mounting plate spaced above the surface of the drum;

b. fluid spray means mounted on said mounting plate, for spraying a lubricating fluid onto the surface of the drum;

c. flexible absorbent mat means mounted on said mounting plate, extending along the width of the drum, for contacting the surface of the drum, to spread fluid from said spray means in a uniform distribution on the drum surface;

d. flexible scraper blade means mounted on said mounting plate, extending along the width of the drum, for contacting the surface of the drum, to remove debris adhering to the drum surface;

e. first elastic spring means on said support member, for resiliently urging said scraper blade means into contact with the drum surface; and f. second elastic spring means on said mounting plate, for resiliently urging said flexible absorbent mat means into contact with the drum surface.

2. The invention of claim 1 wherein said support member means comprises:

a. a first support bracket affixed to a body portion of the machine and extending downwardly therefrom, said first bracket having a horizontal pivot shaft spaced above the drum and parallel to the width of the drum;

b. a second support bracket affixed to a body portion of the machine and extending downwardly therefrom, said second bracket having a horizontal pivot shaft spaced above the drum and parallel to the width of the drum, said first and second brackets being spaced apart from each other along the width of the drum;

b. a first support arm pivotably mounted on said first support bracket pivot shaft and extending downwardly toward said drum;

c. a second support arm pivotably mounted on said second support bracket pivot shaft and extending downwardly toward said drum; and d. a mounting plate affixed to said support arms, said plate being spaced above the drum and having an upper mounting segment and a lower mounting segment, said segments intersecting to form a downwardly facing angle, with an apex of the angle parallel to the width of the drum.

3. A device for cleaning and lubricating an exterior surface of a drum on an asphalt compacting machine comprising:

a. support member means removably attached to the machine, for supporting a cleaning means and a lubricating means along the width of the drum and spaced from the drum surface;

b. fluid spray means mounted on said support member means, for spraying a lubricating fluid onto the surface of the drum;

c. flexible absorbent mat means mounted on said support member, extending along the width of the drum, for contacting the surface of the drum, to spread fluid from said spray means in a uniform distribution on the drum surface;

d. flexible scraper blade means mounted on said support member, extending along the width of the drum, for contacting the surface of the drum, to remove debris adhering to the drum surface;

e. first elastic spring means on said flexible scraper blade means, for resiliently urging said scraper blade means into contact with the drum surface; and f. second elastic spring means on said flexible absorbent mat means, for resiliently urging said flexible absorbent mat means into contact with the drum surface;

g. said support member means further comprising:

(i) a first support bracket affixed to a body portion of the machine and extending downwardly therefrom, said first bracket having a horizontal pivot shaft spaced above the drum and parallel to the width of the drum;

(ii) a second support bracket affixed to a body portion of the machine and extending downwardly therefrom, said second bracket having a horizontal pivot shaft spaced above the drum and parallel to the width of the drum, said first and second brackets being spaced apart from each other along the width of the drum;

(iii) a first support arm pivotably mounted on said first support bracket pivot shaft and extending downwardly toward said drum;

(iv) a second support arm pivotably mounted on said second support bracket pivot shaft and extending downwardly toward said drum; and (v) a mounting plate affixed to said support arms, said plate being spaced above the drum and having an upper mounting segment and a lower mounting segment, said segments intersecting to form a downwardly facing angle, with an apex of the angle parallel to the width of the drum; and said spray means further comprising:

h. a hollow tubular fluid spray bar mounted on said upper mounting segment and extending along the width of the drum;

i. a plurality of spray nozzles on said spray bar, fluidly communicating with said spray bar and spaced along the width of the drum; and j. means for supplying fluid through said spray bar and nozzles.

4. The invention of claim 3 wherein said flexible absorbent mat means comprises:

a. a plurality of shafts extending downwardly from said upper mounting segment, said shafts being spaced along the width of said drum, each shaft slidably connected to said upper mounting segment and having a lower end extending downwardly toward the drum;

b. a mat holder affixed to said lower ends of said shafts and extending along the width of the drum; and c. a fluid absorbent mat fastened to said mat holder.

5. The invention of claim 4 wherein said blade means comprises a flexible elastomer blade removably affixed to said lower segment and extending downwardly to contact the surface of the drum along the width of the drum.

6. The invention of claim 5 wherein said first elastic spring means comprises;

a. a first elastic torsion spring spaced on said horizontal pivot shaft of said first bracket and having a first end connected to said first bracket and a second end connected to said first support arm; and b. a second elastic torsion spring spaced on said horizontal pivot shaft of said second bracket and having a first end connected to said second bracket and a second end connected to said second support arm.

7. The invention of claim 6 wherein said second elastic spring means comprises:

a. and elastic spring slidably positioned on each shaft compressedly contacting said mat holder and said upper mounting segment.

8. A device for cleaning and lubricating an exterior surface of a drum on an asphalt compacting machine comprising:

a. support member means removably attached to the machine, for supporting a cleaning means and a lubricating means adjacent to each other along the width of the drum and spaced from the drum surface;

b. said cleaning means comprising:

(i) flexible scraper blade means mounted on said support member, extending along the width of the drum, for contacting the surface of the drum, to remove debris adhering to the drum surface; and (ii) first elastic spring means on said support member means, for resiliently urging said scraper blade means into contact with the drum surface; and c. said lubricating means comprising:

(i) fluid spray means mounted on said support member means, for spraying a lubricating fluid onto the surface of the drum;

(ii) flexible absorbent mat means mounted on said support member, extending along the width of the drum, for contacting the surface of the drum, to spread fluid from said spray means in a uniform distribution on the drum surface; and (iii) second elastic spring means on said absorbent mat means, for resiliently urging said flexible absorbent mat means into contact with the drum surface.

* * * * *